US006819043B2

(12) United States Patent
Lee et al.

(10) Patent No.: US 6,819,043 B2
(45) Date of Patent: Nov. 16, 2004

(54) ELECTROLUMINESCENT DEVICE AND METHOD OF MANUFACTURING THE SAME

(75) Inventors: Yong Eui Lee, Seoul (KR); Sang Hee Park, Daejon-Shi (KR); Sun Jin Yun, Daejon-Shi (KR); Yong Shin Kim, Daejon-Shi (KR)

(73) Assignee: Electronics and Telecommunications Research Institute, Daejon-shi (KR)

( * ) Notice: Subject to any disclaimer, the term of this patent is extended or adjusted under 35 U.S.C. 154(b) by 40 days.

(21) Appl. No.: 10/238,273

(22) Filed: Sep. 10, 2002

(65) Prior Publication Data

US 2003/0141805 A1 Jul. 31, 2003

(30) Foreign Application Priority Data

Jan. 25, 2002 (KR) ..... 2002-0004433

(51) Int. Cl.[7] ..... H01J 1/62
(52) U.S. Cl. ..... 313/506; 313/498
(58) Field of Search ..... 313/491, 496, 313/503, 506, 631, 634

(56) References Cited

U.S. PATENT DOCUMENTS 4,737,684 A 4/1988 Seto et al.

OTHER PUBLICATIONS

Etching of Crystals; Theory, Experiment, and Application by K. Sangwal; Institute of Physics, Poland 1987 pp. 425, 432.

A tunnel thin film electroluminescent device; C.J. Summers et al; Appl. Phys. Lett. Jan. 13, 1997 pp. 234–236.

Texture etched ZnO:Al coated glass substrates for silicon based thin film solar cells; by O. Kluth et al. Thin Solid Films (1999) pp. 247–253.

The effect of despition temperature on the properties of Al–doped zinc oxide thin films; J.F. Chang et al. Thin Solid Films 386 (2001) pp. 79–86.

Optical and electrical properties of direct–current magnetron–sputtered ZnO; Al films vol. 90, No. 7, Journal of applied physics Oct. 1, 2001 pp. 3432–3436.

Synthesis and optelectronic characterization of gallium doped zinc oxide transparent electrodes; GA Hirata et al.; Thin Solid Films 288 (1996) pp. 29–31.

*Primary Examiner*—Vip Patel
(74) *Attorney, Agent, or Firm*—Blakely Sokoloff Taylor & Zafman LLP

(57) ABSTRACT

The present invention relates to an electroluminescent device and method of manufacturing the same, capable of reducing the loss of light propagated toward the lateral side of the device and increasing the amount of light propagated to the front of the display to improve the brightness and efficiency of the device, in such a way that a transparent conductive film or a luminescent layer is made of compound having an orientation and is then etched to make the transparent conductive film or the luminescent layer in a protrusion shape. For this, an electroluminescent device comprises a substrate, a first electrode formed on the substrate, a luminescent layer formed on the first electrode, and a second electrode formed on the luminescent layer, wherein at least one of the first electrode, the luminescent layer and the second electrode is formed to have a protrusion at its surface is formed to have a surface of a protrusion shape at its given region.

8 Claims, 6 Drawing Sheets

| substance | oxidant/reactant | complexing reagent | diluent/medium | additive |
|---|---|---|---|---|
| ZnO | $HNO_3$ | - | $CH_3COOH$, $H_2O$ | |
| ZnS | $K_2Cr_2O_7$ | $H_3SO_4$ | $H_2O$ | |
| | $H_2O_2$ | - | $H_2O$ | |
| | $HCl/HNO_3$ | - | $H_2O$ | |
| | $H_3PO_4$ | - | | |
| | HCl | - | vapor, $C_2H_5OH$ | |
| | $HNO_3$ | $CH_3COOH$ | $H_2O$ | |
| | $K_2Cr_2O_7$ | $H_2SO4$ | $H_2O$ | |
| | $CrO_3$ | $H_2SO4$ | $H_2O$ | |

ELECTROLUMINESCENT DEVICE AND METHOD OF MANUFACTURING THE SAME

BACKGROUND OF THE INVENTION

1. Field of the Invention

The invention relates generally to an electroluminescent device (hereinafter, "ELD") and method of manufacturing the same. More particularly, it relates to an electroluminescent device and method of manufacturing the same, capable of reducing the loss of light propagated along the lateral side of the device and increasing the amount of light propagated to the front of the display to improve the brightness and efficiency of the device, in such a way that a transparent conductive film or a luminescent layer is made of materials having crystallographic anisotropy and is then etched to make the transparent conductive film or the luminescent layer with a protrusion shaped or textured surface feature.

2. Description of the Prior Art

An electroluminescence device (hereinafter, "ELD") is one using an electroluminescent phenomena occurring when an electric field is applied to materials such as ZnS, CaS, and the like. SHARP (Japan) announced a thin ELD having a high brightness and a long life (1974). Since then, many researches have been made on the ELD. In particular, C. W. Tang in Eastman Kodak manufactured a thin film ELD using an organic material and reported that a green luminescence of high brightness is possible. As the result, researches have been actively made on an organic ELD having a low driving voltage and being advantageous in the process.

The structure of the ELD may mainly includes an alternating-current thin film type structure, an alternating-current thick film type structure, a direct-current thin film type structure and a direct-current thick film type structure. In detail, the structure of the alternating-current thin film type structure usually includes upper and lower insulating layers with a luminescent layer intervened between them, and the alternating-current thick film type structure including an luminescent material mixed with insulating binder and an insulating layer. Also, the structure of the direct-current type structure includes a thin film type structure having a single insulating layer and a luminescent layer, and a thick film type structure having a luminescent layer.

A structure of a conventional ELD 10 will be described by reference to FIG. 1.

As shown in FIG. 1, the alternating-current thin film ELD 10 includes a transparent substrate such as glass 11, or semiconductor single crystal substrates such as silicon 11 or a flexible substrate 11. A lower electrode 12 as a transparent electrode is formed on the substrate 11. A lower insulating layer 13 formed on the lower electrode 12. A luminescent layer 14 is formed on the lower insulating layer 13. An upper insulating layer 15 is formed on the luminescent layer 14. An upper electrode 16 made of a transparent electrode or a metal electrode is formed on the upper insulating layer 15.

FIG. 10 and FIG. 11 show schematic diagram of the crystal structure and the surface atom arrangement for II-VI and III-V compounds, respectively. III-V group compounds have a cubic or hexagonal structure. In FIG. 10, A/A' indicate II group or III group atoms and B/B' indicate VI group or V group atoms. Also, the direction of the arrows is (111) in case of the cubic system and (0001) in case of the hexagonal system. Also, FIG. 11 shows the electron arrangement of A and B atoms each constituting {0001} or {111} crystal surfaces of II-VI group or III-V group compound. In FIG. 11, A indicates II group or III group atoms and B indicates VI group or V group atoms.

However, the conventional ELD 10 having this structure did not have the brightness and efficiency sufficient to be applicable to the display requiring a high brightness and efficiency. Therefore, there is an urgent need for a new ELD having a high brightness and efficiency.

In order to solve this problem, many researches haven been made on a new ELD having these high brightness and efficiency characteristics. For example, the crystallinity of phosphor materials constituting the ELD, the degree of activation for activator ions, the number of accelerated electrons, and the energy and its distribution must be controlled. For this, a method of manufacturing various phosphor materials and an annealing method for the purpose of an improved crystal property of the phosphor materials and an effective activation of the activator ions. Also, there has been proposed a method of using an insulating material having high dielectric constant in order to generate accelerated electrons having high energy of narrow energy distribution.

Meanwhile, in order to manufacture a ELD of a high brightness and a high efficiency as described above, a solution by which the amount of light emitted toward the lateral side of the ELD display is promising. As the surface and flatness of the film adopted in the conventional ELD is usually smooth and good, 80~90% of emitted lights from activator ions actually propagate along the interface between the insulating layer and the luminescent layer or the interface between the insulating layer and the electrode layer and can not emitted to front side due to so called "Light-Piping" or "Waveguide" effect. Due to this, the light traveling toward the front of the display that can contribute an actual optical efficiency is only 10~20% of the total.

SUMMARY OF THE INVENTION

The present invention is contrived to solve the above problems and an object of the present invention is to increase the scattering of light by deforming the surface of a film constituting an ELD in order to manufacture the ELD having a high brightness and high efficiency.

Further, another object of the present invention is to simplify the process by applying ZnO that can be relatively easily etched as compared to the transparent electrode made of conventional indium tin oxide (hereinafter, "ITO") to a process of forming the transparent electrode.

In order to accomplish the above object, an electroluminescent device according to the present invention is characterized in that it comprises a substrate, a first electrode formed on the substrate, a luminescent layer formed on the first electrode, and a second electrode formed on the luminescent layer, wherein at least one of the first electrode, the luminescent layer and the second electrode is formed to have a protrusion or texture at its surface.

Preferably, the electroluminescent device further includes a first insulating layer formed between the first electrode and the luminescent layer; and a second insulating layer formed between the luminescent layer and the second electrode.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF PREFERRED EMBODIMENTS

The present invention will be described in detail by way of a preferred embodiment with reference to accompanying drawings.

Figure 1:
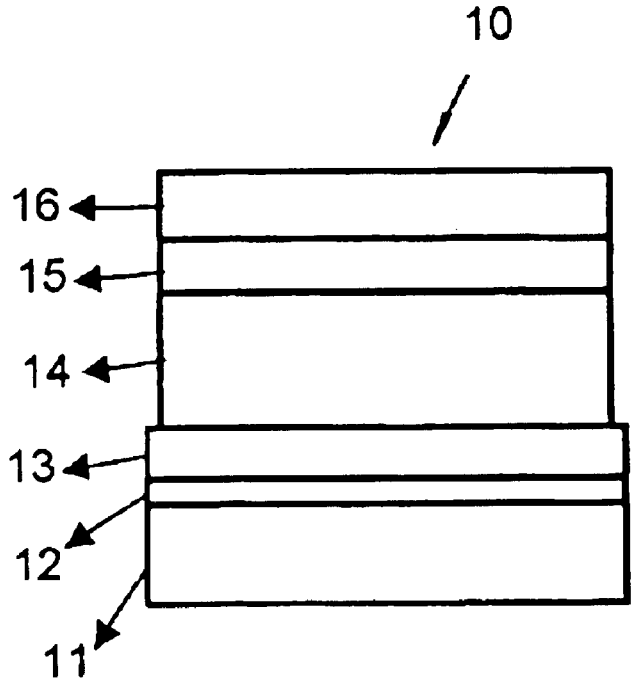
FIG. 1 (Prior Art)
FIG. 1 is a cross-sectional view of a conventional electroluminescent device.
Figure 2:
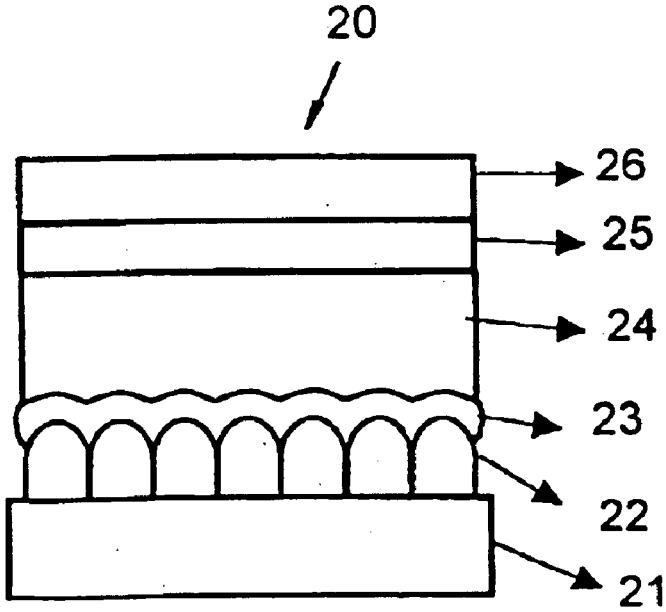
FIG. 2 is a cross-sectional view of an electroluminescent device according to a first embodiment of the present invention.

FIG. 2 is a cross-sectional view of an ELD 20 according to a first embodiment of the present invention.

As shown in FIG. 2, the ELD 20 includes a transparent lower electrode 22 of a protrusion shape on a substrate 21, a lower insulating layer 23, a luminescent layer 24 made of II-VI group compound or III-V group compound, an upper insulating layer 25, and an upper electrode 26 made of a transparent electrode or a metal electrode.

A method of manufacturing the ELD 20 will be below described.

A ZnO film having a hexagonal wurtzite crystal system doped with III group elements (B, Al, Ga, In) fabricated by physical and chemical vacuum thin film deposition apparatus, as the transparent lower electrode 22 of a protrusion shape, is first formed on the substrate 21 such as a transparent substrate, a semiconductor single crystal substrate of silicon, etc. or a flexible substrate.

A process of forming the transparent lower electrode 22 with a protrusion shape will be below described in detail.

III group element is first doped and the ZnO film having a c-axis orientation is formed with thickness of 0.1~10 $\mu$m. It should be noted that the type of the film is not particularly limited but various types of the film may be used. For example, the film may be made of ZnS, CdS, and the like. For convenience of explanation, the film made of ZnO will be described in the present embodiment. Further, many kinds of methods of forming the film are available. For example, the methods may include a radio frequency magnetron sputtering method written in "The Effect of Deposition Temperature on the Properties of Al-Doped Zinc Oxide Thin Film": Thin Solid Films by J. F. Chang, et al (2001), a direct-current magnetron sputtering method written in "Optical and Electrical Properties of Direct-Current Magnetron Sputtered ZnO:Al Films": J. Appl. Phys. by Z. L. Pei, et at. (2001), a pulse laser deposition method written in "Synthesis and Optoelectronic Characterization of Gallium Doped Zinc Oxide Transparent Electrodes": Thin Solid Films by G. A. Hirata et al (1996), and the like.

Meanwhile, the process condition using the thin film deposition method will be described. The process condition are follows; the substrate temperature is room temperature—400° C., the pressure is 1~100 mTorr and the gas partial ratio of oxygen and argon ($O_2/(O_2+Ar)$) is in the range of 0~50%.

The transparent conductive ZnO film doped with III group elements (B, Al, Ga, In) has the c-axis orientation. C-axis orientation means crystallographic direction of (0001) in the ZnO film is vertical to the substrate.

Figures 3, 4:
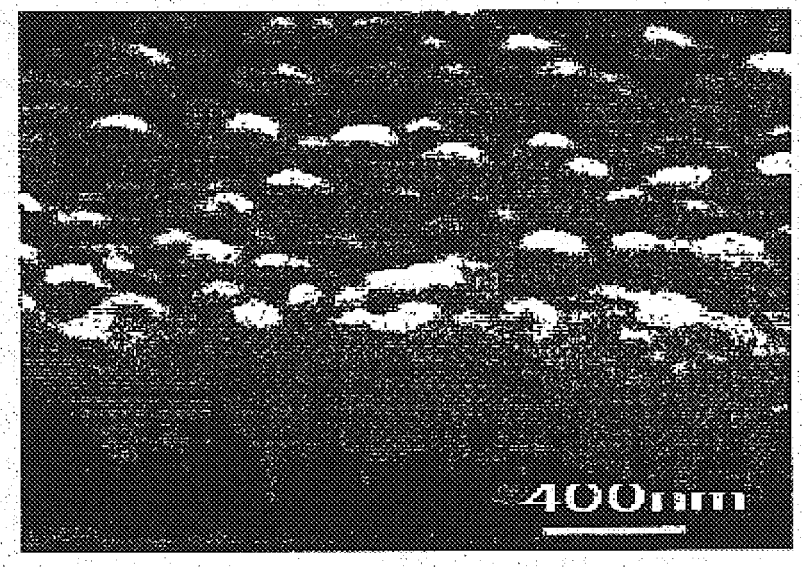
FIG. 3 is a table showing an example of an etching solution depending on II-VI group or III-V group compound.
FIG. 4 is a SEM photography showing a lower electrode having the surface of a protrusion shape according to the first embodiment of the present invention.

Next, after the ZnO film is formed, a given portion of the ZnO film is etched by wet etch process. FIG. 3 shows the examples of the etching solution which is available when the etching is performed. As shown in FIG. 3, the ZnO film is wet-etched using an solution containing $HNO_3$, $CH_3COOH$ and $H_2O$ with optimum concentration ratio. The etching solution depending on the type of a film can be found in "Etching of Crystals Theory, Experiment, and Application": Elsevier Science Publishers by K. Sangwal (1987).

Further, the etching time differs depending on the thickness of a film. In case that the thickness of the film is 0.1~10 $\mu$m, as described above, the etching time is about 1 second 3 minutes and the etching temperature is room temperature~50° C. Thus, the ZnO film having the c-axis orientation the surface of which has a protrusion shape is formed by the etching process. In other words, the etching time is different due to crystal and chemical anisotropy property at the surface of the films. Due to this selective etching behavior, a region having defects within the film is firstly etched if the etching is performed for a given period of time, so that the surface of the film has a protrusion shape.

FIG. 4 is a SEM photography showing a lower electrode the surface of which has a protrusion shape by a wet etching process. "Protrusion Shape" means that protrusions of a micro-lens shape are closely formed as shown in FIG. 4.

Next, the lower insulating layer 23 is formed on the transparent lower electrode 22 of a protrusion shape. ZnS:Mn is then formed in thickness of 0.5~1.5 $\mu$m by means of electron beam evaporation method or sputtering method and is experienced by a rapid annealing process at the temperature of 500~750° C. to form the luminescent layer 24. At this time, the luminescent layer 24 is usually made of all materials in which electroluminescent-based ions emitting a red color, a green color, a blue color or a white color are doped into II-VI group or III-V group oxide or sulphide luminescent mother's body. Also, the luminescent layer 24 may be fabricated by common physical and chemical vacuum film deposition method.

Then, the upper insulating layer 25 is formed on the luminescent layer 24 made of III-VI group or III-V group compound. The upper electrode 26 is formed using the transparent electrode and the metal electrode. The materials of the lower and upper insulating layers 23 and 25 are not limited to the above examples but may be formed using various insulating materials having an insulating property. For example, the insulating materials may include SiN or SiO series. Through these processes, the ELD 20 according to the first embodiment of the present invention is completed.

Figure 5:
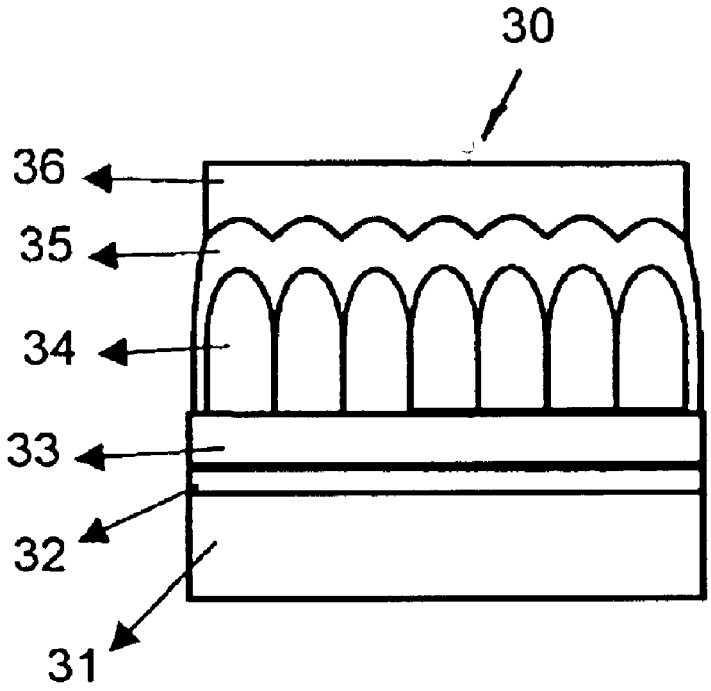
FIG. 5 is a cross-sectional view of an electroluminescent device according to a second embodiment of the present invention.

An ELD 30 according to a second embodiment of the present invention will be described below by reference to FIG. 5.

It is described in the first embodiment that the surface of the lower electrode has a protrusion shape. It is, however, described in the second embodiment that the surface of the luminescent layer as a protrusion shape. Therefore, as the ELD 30 in the second embodiment is manufactured by almost same processes in the first embodiment, different processes from the first embodiment will be described below.

The ELD 30 include a substrate 31, a lower electrode 32, a luminescent layer 34 the surface of which has a protrusion shape, an upper insulating layer 35 and an upper electrode 36.

A method of manufacturing the ELD 30 having this structure will be below described.

The lower electrode 32 such as a transparent electrode or a metal electrode is first formed on the substrate 31 such as a transparent substrate, a semiconductor single crystal substrate of silicon or a flexible substrate. The lower insulating layer 33 is then formed on the lower electrode 32. In this case, the material of the lower electrode 32 is not limited to the above example but may be formed using various materials. For example, a transparent conductive ZnO film into which ITO, i.e., one of B, Al, Ga and In, that are used in the first embodiment, is doped may be used as the lower electrode 32.

Next, the luminescent layer 34 the surface of which has a protrusion shape, that is made of II-VI group or III-V group compound, is formed on the lower insulating layer 33. At this time, the luminescent layer 34 of the protrusion shape is formed by the same method in the first embodiment. The etching solutions in shown in FIG. 3 are wet-etched to form the protrusion shape.

Thereafter, the upper insulating layer 35 is formed on the luminescent layer 34 the surface of which has the protrusion shape. The upper electrode 36 is then formed using the transparent electrode and the metal electrode. Thus, the ELD 30 according to the second embodiment of the present invention is completed.

Figure 6:
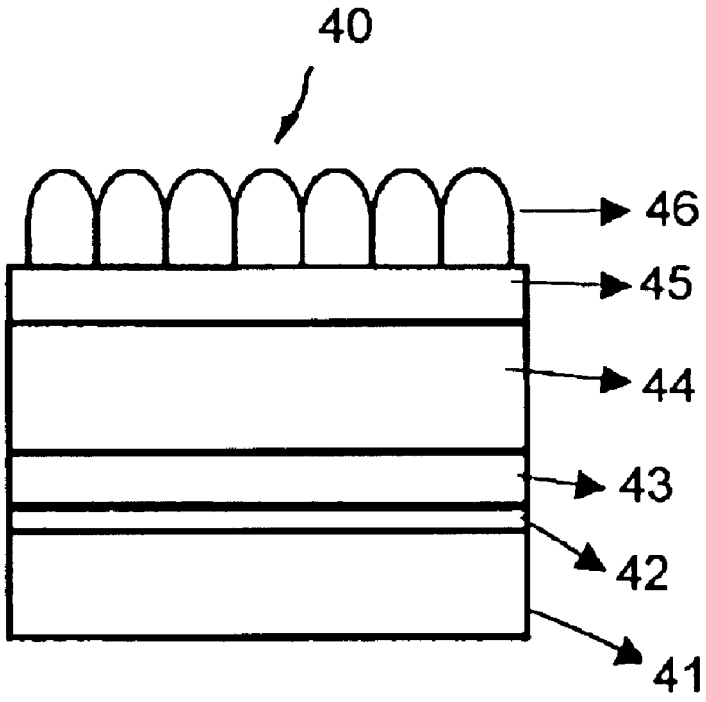
FIG. 6 is a cross-sectional view of an electroluminescent device according to a third embodiment of the present invention.

An ELD 40 according to a third embodiment of the present invention will be described by reference to FIG. 6.

It is described in the first and second embodiments that the lower electrode and the luminescent layer have a protrusion shape, respectively. It is, however, described in the third embodiment that the upper electrode has a protrusion shape. Therefore, as the ELD 40 in the third embodiment is manufactured by almost same processes in the first embodiment, different processes from the first embodiment will be described below.

The ELD 40 includes a substrate 41, a lower electrode 42, a luminescent layer 44, an upper insulating layer 45, and an upper electrode 46 the surface of which has a protrusion shape.

A method of manufacturing the ELD 40 having this structure will be below described.

The lower electrode 42 is first formed on the substrate 41 such as a transparent substrate, a semiconductor single crystal substrate of silicon or a flexible substrate. The lower insulating layer 43 is then formed on the lower electrode 42.

Then, the luminescent layer 44 is formed on the lower insulating layer 43. The upper insulating layer 45 is formed on the luminescent layer 44. The upper electrode 46 the surface of which has the protrusion shape is then formed y the method same to the first embodiment.

Figure 7:
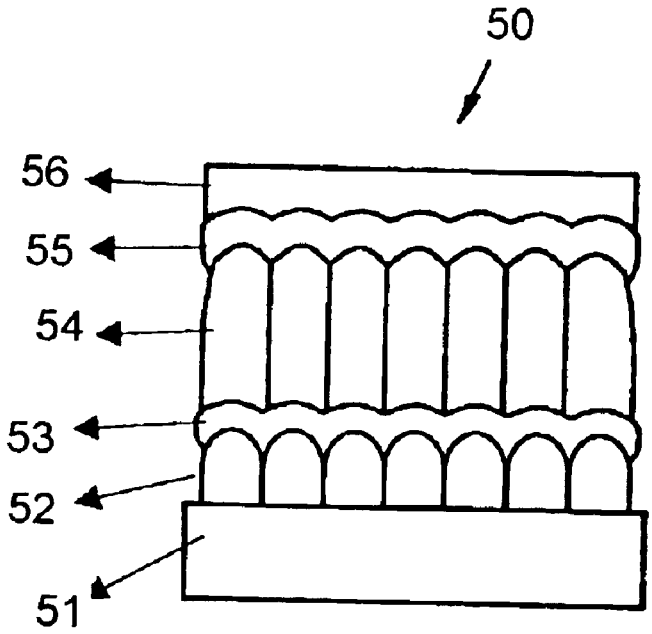
FIG. 7 is a cross-sectional view of an electroluminescent device according to a fourth embodiment of the present invention.
Figure 8:
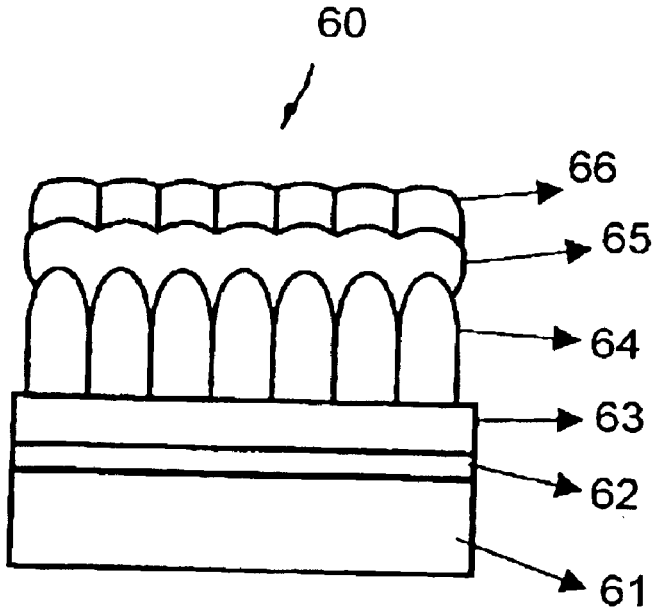
FIG. 8 is a cross-sectional view of an electroluminescent device according to a fifth embodiment of the present invention.
Figure 9:
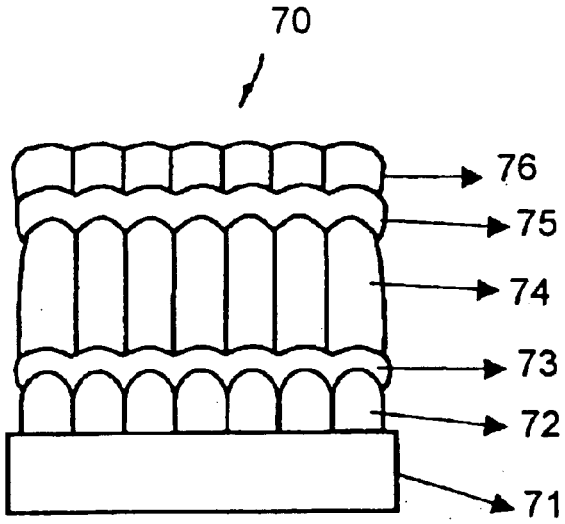
FIG. 9 is a cross-sectional view of an electroluminescent device according to a sixth embodiment of the present invention.
Figure 10:
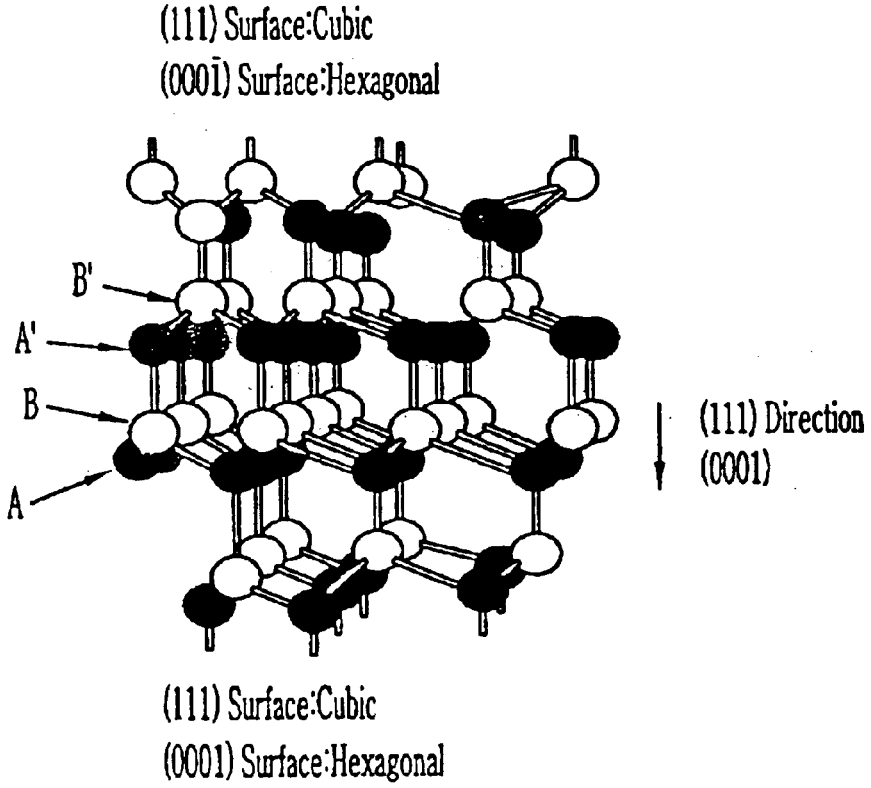
FIG. 10 (Prior Art)
FIG. 10 shows the atom arrangement of II-VI group or III-V group compound having cubic or hexagonal crystal system.
Figure 11:
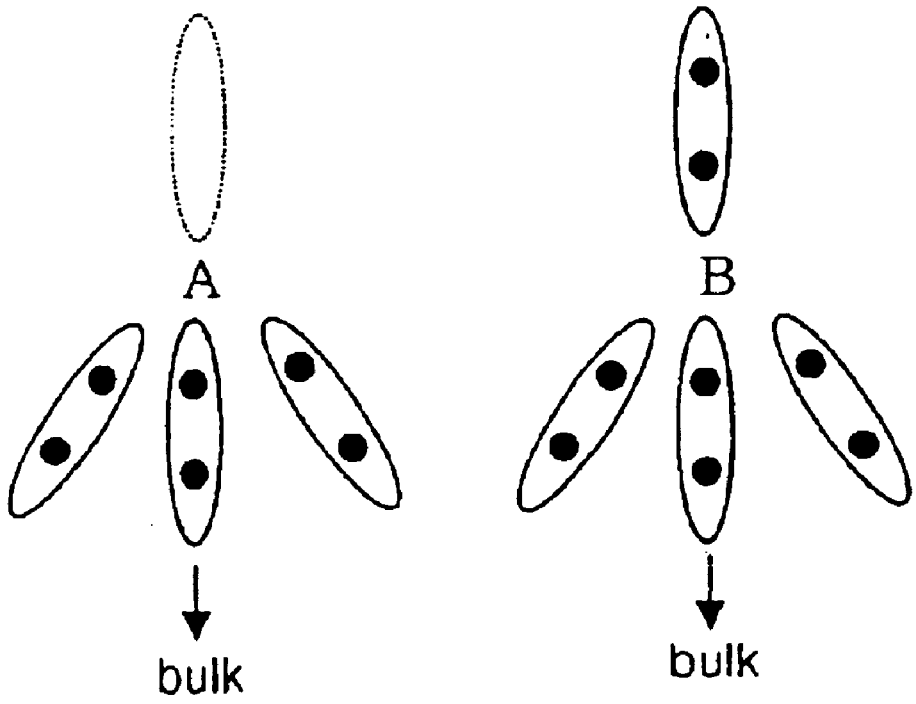
FIG. 11 (Prior Art)
FIG. 11 shows the electron arrangement of A and B atoms each constituting {0001} or {111} crystal surfaces of II-VI group or III-V group compound.

Fourth, fifth and sixth embodiments of the present invention will be described by reference to FIGS. 7, 8 and 9.

The ELD according to the fourth embodiment has a structure in which the lower electrode the surface of which has the protrusion shape in the first embodiment and the luminescent layer the surface of which has the protrusion shape in the second embodiment are all adopted.

Further, the ELD according to the fifth embodiment has a structure in which the luminescent layer the surface of which has the protrusion shape in the second embodiment and the upper electrode the surface of which has the protrusion shape in the third embodiment are all incorporated.

Meanwhile, the manufacture processes in the fourth, fifth and sixth embodiments are same to the foregoing embodiment and the type of the film using the surface of the protrusion shape is different. For convenience, a detailed explanation will be omitted.

Further, in implementing the ELD according to the first~sixth embodiments of the present invention, a region where the protrusion shape is formed may be formed to have a given region. For example, in case of the first embodiment, the region of the protrusion shape in the lower electrode 22 may be formed to partially have a region from which lots of light is reflected. Further, in case of the fourth embodiment, the protrusion portions may be formed at different regions in the lower electrode 52 and the luminescent layer 54. In other words, when viewing the ELD 50 from an upper side, the region where the protrusion is formed at the lower electrode 52 and the region where the protrusion is formed at the luminescent layer 54 may be formed at different regions.

Meanwhile, it should be noted that a protrusion shape may be formed on the surface of the transparent electrode, as described in the first embodiment of the present invention, in fabricating common field emission display, liquid crystal display, plasma display panel, and the like. For example, the transparent conductive film at a region through which light of the liquid crystal display passes is formed using a ZnO film having a conductive film so that it has a protrusion shape.

Meanwhile, the film thickness, and the like in the drawings, is exaggerated in order to emphasize a clear explanation. Further, in the above description, it is written that any film exists on other film or "on" the substrate. However, it should be noted that the any film may directly exist on the other film or the substrate or a third film may be intervened between the any film and the other film or the substrate.

As mentioned above, according to the present invention, a luminescent layer or a transparent conductive film constituting the ELD is made to have a protrusion shape made of II-VI group or III-V group compound. Thus, the present invention has an advantage that it can significantly reduce the loss of light emitted along the lateral side of the device and thus increase the amount of light propagated toward the front of the display to improve the brightness and efficiency of the display.

Further, the present invention can simplify the process, by using ZnO that can be relatively easily etched than a existing tin-doped ITO transparent electrode to a process of forming the transparent electrode.

The present invention has been described with reference to a particular embodiment in connection with a particular application. Those having ordinary skill in the art and access to the teachings of the present invention will recognize additional modifications and applications within the scope thereof.

It is therefore intended by the appended claims to cover any and all such applications, modifications, and embodiments within the scope of the present invention.

What is claimed is:

1. An electroluminescent device, comprising:

a substrate, a first electrode formed on the substrate, a luminescent layer formed on the first electrode, and a second electrode formed on the luminescent layer, wherein at least one of the first electrode, the luminescent layer and the second electrode have a surface of a protrusion or texture shape at its given region.

2. The electroluminescent device as claimed in claim 1, further including a first insulating layer formed between the first electrode and the luminescent layer; and a second insulating layer formed between the luminescent layer and the second electrode.

3. The electroluminescent device as claimed in claim 2, wherein the luminescent layer is made of oxide or sulphide that emits a red color, a green color, a blue color or a white color, among II-VI group compound or III-V group compound.

4. The electroluminescent device as claimed in claim 2, wherein in case that the first electrode and/or the second electrode have/has the surface of the protrusion shape, thee electrode having the protrusion shape is made of II-VI group compound or III-V group compound into which atoms of III group are doped.

5. The electroluminescent device as claimed in claim 4, wherein said electrode having the protrusion shape is made of ZnO having a hexagonal Wurtzite crystal system into which at least one of B, Al, Ga and In is doped.

6. The electroluminescent device as claimed in claim 1, wherein the luminescent layer is made of oxide or sulphide that emits a red color, a green color, a blue color or a white color, among II-VI group compound or III-V group compound.

7. The electroluminescent device as claimed in claim 1, wherein in case that the first electrode and/or the second electrode have/has the surface of the protrusion shape, the electrode having the protrusion shape is made of II-VI group compound or III-V group compound into which atoms of III group are doped.

8. The electroluminescent device as claimed in claim 7, wherein said electrode having the protrusion shape is made of ZnO having a hexagonal Wurtzite crystal system into which at least one of B, Al, Ga and In is doped.

* * * * *